US006360544B1

(12) United States Patent
Albertson

(10) Patent No.: US 6,360,544 B1
(45) Date of Patent: Mar. 26, 2002

(54) ANTICYCLONE POWERED ACTIVE THERMAL CONTROL UNIT

(75) Inventor: Todd P. Albertson, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/741,454

(22) Filed: Dec. 19, 2000

(51) Int. Cl.[7] ..... F25B 21/02
(52) U.S. Cl. ..... 62/3.7
(58) Field of Search ..... 62/3.2, 3.3, 3.7, 62/259.2; 165/80.4

(56) References Cited

U.S. PATENT DOCUMENTS 2,992,538 A * 7/1961 Poganski ..... 62/3.2
2,993,340 A * 7/1961 Sheckler ..... 62/3.2
3,478,230 A * 11/1969 Otter et al. ..... 62/3.7
6,055,815 A * 5/2000 Peterson ..... 62/3.7

* cited by examiner

*Primary Examiner*—Henry Bennett
*Assistant Examiner*—Melvin Jones
(74) *Attorney, Agent, or Firm*—Schwegman, Lundberg, Woessner & Kluth, P.A.

(57) ABSTRACT

A thermal control unit for regulating the temperature of a component or device under test is disclosed. The thermal control unit includes a three-dimensional control structure having a base member and an extension member extending from one surface of the base member to divide the base member into first and second portions. The base member has another surface to thermally couple to the device. The thermal control unit further includes at least one heat transfer assembly in thermal contact with the first portion of the base member and one face of the extension member and at least one other heat transfer assembly in thermal contact with the second portion of the base member and another face of the extension member.

30 Claims, 6 Drawing Sheets

ANTICYCLONE POWERED ACTIVE THERMAL CONTROL UNIT

FIELD OF THE INVENTION

The present invention relates generally to temperature control devices, and more particularly to an anticyclone powered active thermal control unit to control the temperature of an apparatus, such as an integrated heat spreader on a high-powered microprocessor or other device.

BACKGROUND INFORMATION

Electronic devices and circuits are being required to perform more functions at ever increasing speeds. At the same time component densities are increasing while packaging size requirements are decreasing. The higher component densities, higher operating frequencies and tighter packaging requirements are resulting in the generation of excessive heat that must be managed for proper operation and longevity of today's high performance electronic devices and circuits.

Additionally, in some circumstances it may be desirable to test electronic circuits and devices to determine how they will operate under temperature extremes. Subjecting these devices to such conditions can serve to identify defective components that will fail under extreme hot or cold conditions. Extreme temperature testing may also serve to identify redesign requirements to make the device more robust.

A known device for use in controlling the temperature of a high-performance, high-powered device, such as a microprocessor or the like, for either heat management or testing, is a thermal control unit typical of that shown in FIG. 1. The thermal control unit 100 includes a two-dimensional control structure 102. Thermoelectric modules 104 are disposed on the control structure 102 and may be thermally coupled to the control structure 102 by a layer of thermal interface material 106. A heat exchanger 108 is disposed over the thermoelectric modules 104 and may also be thermally coupled to the thermoelectric modules 104 by another layer of thermal interface material 110. A temperature sensor 112 in the control structure 102 thermally contacts the device 114 under test or device whose temperature is to be controlled by the thermal control unit 100 and provides a signal representative of a temperature of the device 114 to a temperature controller (not shown). The temperature controller then regulates the current flow through the thermoelectric modules 104 to heat or cool the control structure 102 and consequently control the temperature of the device 114.

As evident from FIG. 1, the thermal control unit 100 only has the ability to transfer heat flux (Watts/$m^2$) in two dimensions through the planar control structure 102. Thermoelectric modules 104 can be added in an array arrangement which may improve the total heat transfer abilities of the unit 100 but will not drastically improve the unit's ability to control large heat fluxes.

Another way current thermal control units 100 deal with large heat fluxes is to increase the surface area of control structure 102 so that more thermoelectric modules 104 or larger thermoelectric modules 104 can be placed on the two dimensional planar control structure 102. This, however, requires a proportionate increase in the surface area of the device 114 under test through which heat flux can be transferred.

Another problem presented by increasing the number of thermoelectric modules 104 is the increase in power and control wiring. Most thermal control units 100 now contain at least four thermoelectric modules 104 to manage the higher heat transfer demands during testing. This results in a minimum of eight large power wires connected together internally within the thermal control unit 100. These wires also need to be strain relieved, resulting in a complex assembly process. Solder joints can also fatigue and break if not properly strain relieved or if poor solder techniques are employed, thus resulting in reduced reliability of the thermal control unit 100. Additionally the temperature sensor 112 or resistive temperature device used to sense the temperature of the device 114 under test for temperature control purposes typically utilizes very fragile wires, which are most often smaller than 30 gauge. Accordingly, these wires may also be broken if care is not taken during assembly of the thermal control unit 100, necessitating that the unit 100 be disassembled and the wiring repaired.

Another issue with current thermal control units 100 is that the thermoelectric modules 104 are made of a ceramic material and are very sensitive to non-uniform loading that can cause cracking resulting in expensive repairs and downtime of the test equipment. Additionally, the two-dimensional array arrangement of thermoelectric modules 104 of current thermal control units 100 cause the forces resulting from actuation of the device 114 under test to be applied through the thermoelectric modules 104. This results in an additional fatigue mechanism being applied to the thermoelectric modules 104 that can shorten their useful life. The non-uniform loading and the actuation of the thermal control unit 100 onto the device 114 under test will cause fatigue loading that can also result in the thermal interface film or material 106 and 110 breaking down and weeping from the thermoelectric modules 104, heat exchanger 108 and the control structure 102.

Accordingly, for the reasons stated above, and for other reasons that will become apparent upon reading and understanding the present specification, there is a need for a thermal control unit that has the ability to regulate large heat fluxes, addresses power and control wiring management problems, and uneven loading of thermoelectric modules to improve unit reliability and longevity. Additionally, there is also a need for a thermal control unit that can easily be adapted to any type test equipment, such as product platform validation (PPV) test equipment or the like.

DESCRIPTION OF THE EMBODIMENT

In the following detailed description of the preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the present invention.

Figure 1:
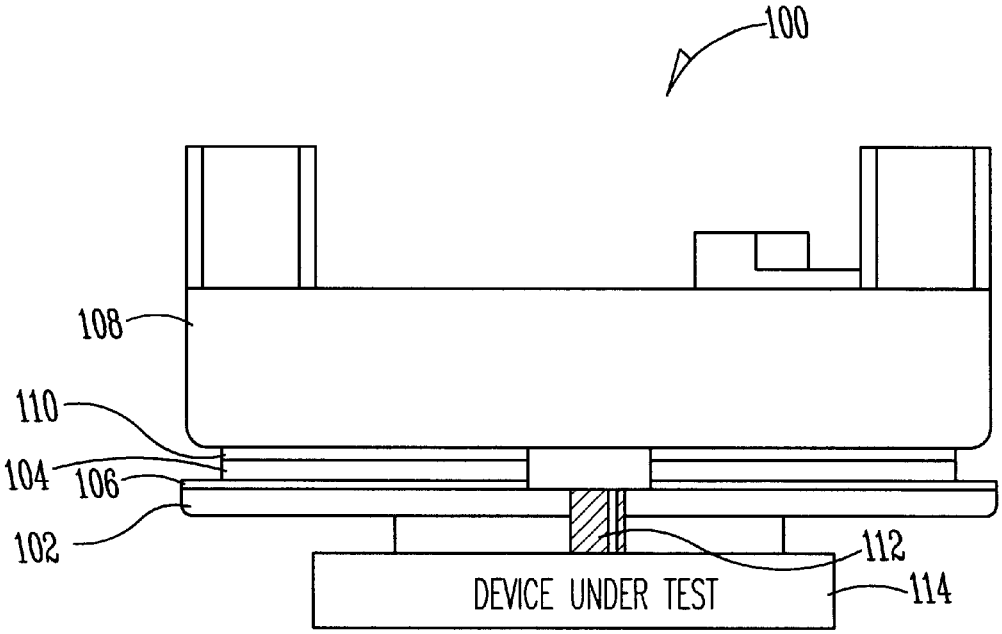
Fig. 1 (Prior Art)
FIG. 1 is a side elevation view of a prior art thermal control unit.
Figure 2:
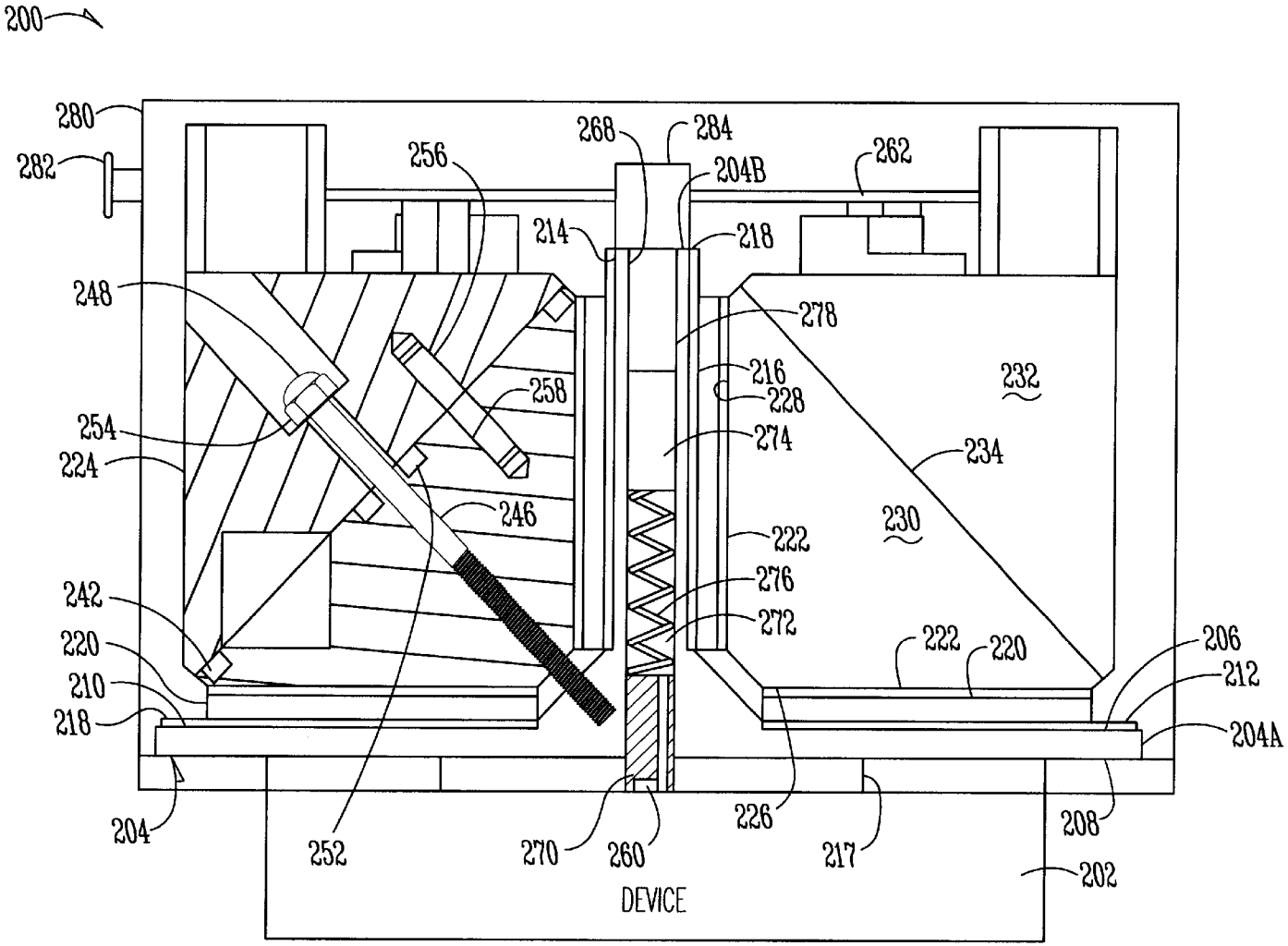
FIG. 2 is a side elevation view of a thermal control unit in accordance with the present invention.

Referring to FIG. 2, a thermal control unit 200 is shown thermally coupled to a device 202 under test or component whose temperature is controlled or regulated by the thermal control unit 200. The thermal control unit 200 includes a control structure 204 that includes a base member 204*a* and an extension member or vertical member 204*b*. The base member 204*a* may have a substantially planar shape including one surface 206 and an opposite surface 208 for thermally coupling to the device 202. The extension member 204*b* may also have a substantially planar shape that extends substantially perpendicular from the one surface 206 of the base member 204*a* and divides the one surface 206 into first and second portions 210 and 212. The extension member 204*b* also includes a first face 214 and a second face 216.

An integrated heat spreader 217 may be disposed between the device 202 and the base member 204*a* of the control structure 204 to facilitate the dispersion and transfer of heat to the thermal control unit 200. The integrated heat spreader 217 may have a substantially planar shape and may be of any material that easily disperses and transfers heat, such as copper, aluminum or the like.

Figure 3:
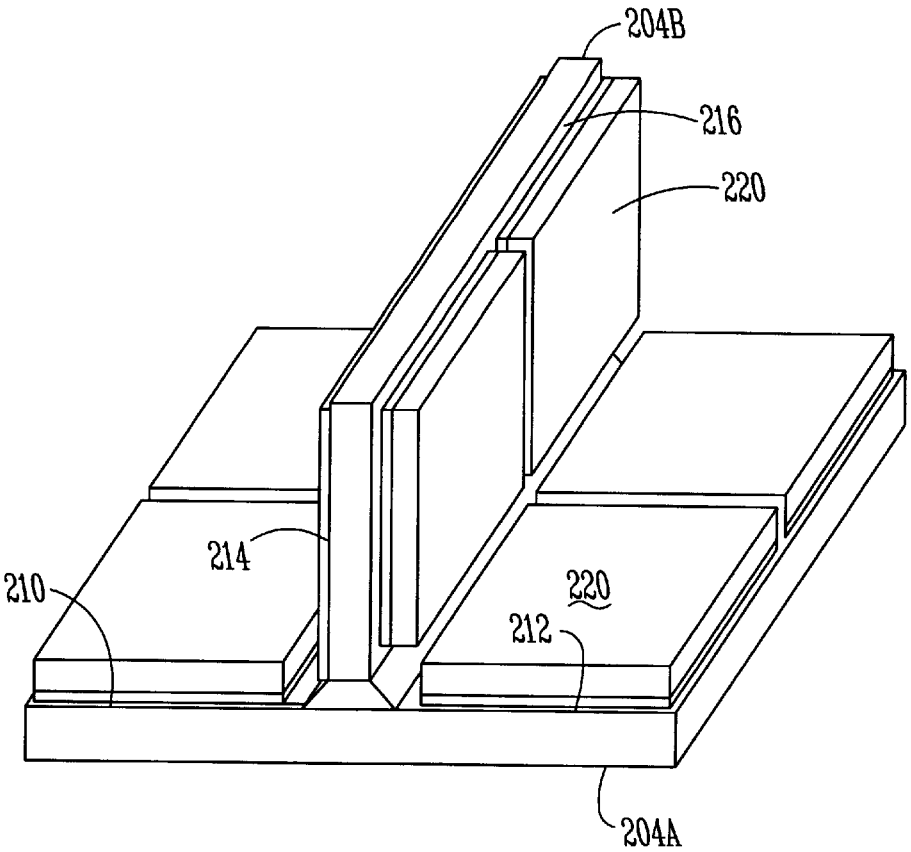
FIG. 3 is a perspective view of a control structure and thermoelectric modules in accordance with the present invention.

A layer 218 of thermal interface material such as AOS HTC #52031 or the like may be deposited on the one surface 206 of the first and second portions 210 and 212 of the base member 204*a* and on the first and second faces 214 and 216 of the extension member 204*b*. At least one thermoelectric module 220 is positioned on the first and second portions 210 and 212 of the base member 204*a* and on the first and second faces 214 and 216 of the extension member 204*b*. Depending upon cooling or heating requirements and the size of the control structure 204 and thermoelectric modules, more than one thermoelectric module 220 may be needed on each portion 210 and 212 of the base member 204*a* and each face 214 and 216 of the extension member 204*b*. FIG. 3 shows two thermoelectric modules 220 on each portion 210 and 212 and face 214 and 216. The thermoelectric modules 220 act like heat pumps either transferring heat from or into the control structure 204. The control structure 204 becomes hot when transferring heat from the thermoelectric modules 220 to the control structure 204 and the control structure 204 becomes cool when transferring heat from the control structure 204 to the thermoelectric modules 220. The arrangement of the thermoelectric modules 220 into a three-dimensional array concentrates the heat flux capability in a location directly above the device 202 thus improving the efficiency of the thermal control unit 200 and enabling the thermal control unit 200 to control much greater heat fluxes than conventional two-dimensional thermal control units.

This layout of the thermoelectric modules 220 transmits the actuation loads around the modules 220 and through the control structure 204. This eliminates degradation resulting from uneven or non-uniform loading and repeated loading and unloading of the modules 220 which can cause fatigue of the ceramic modules 220 and hence cracking and damage. The three-dimensional arrangement of the thermoelectric modules 220 also provides significant improvement in temperature control capabilities for devices 202 that have high wattages and generate a significant amount of heat.

Figure 4:
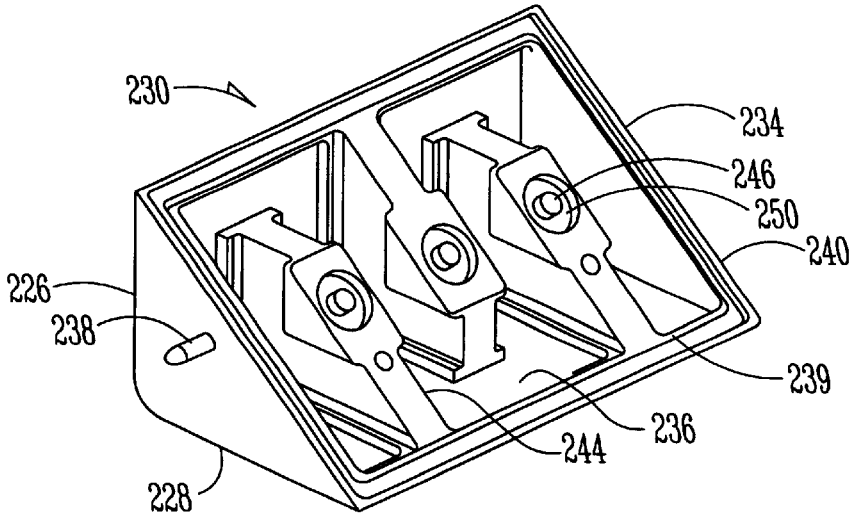
FIG. 4 is a perspective view of one portion of a heat exchanger in accordance with the present invention.

Another layer 222 of thermal interface material may be deposited on each thermoelectric module 220. At least one heat exchanger 224 is positioned on each side of the extension member 204*b*. The heat exchangers 224 are positioned with a first side 226 and a second side 228 thermally coupled via the interface layers 222 to the thermoelectric modules 220 on the base member 204*a* and on the extension member 204*b*, respectively. Each heat exchanger 224 includes a first or lower portion 230 and a second or upper portion 232. A cross-sectional view of the heat exchanger 224 is shown on the left in FIG. 2 and a perspective view of the first or lower portion 230 of the heat exchanger 224 is shown in FIG. 4. The first and second portions 230 and 232 each have a substantially triangular cross-section with the two closed sides 226 and 228 and an open side 234 for matingly attaching to the open side 234 of the other portion 230 or 232 to form an enclosure 236 (FIG. 4) for containing a heat transfer fluid, such as process cooling water (PCW) or the like. The heat exchangers 224 have ports 238 (only one shown in FIG. 4) to permit PCW to be circulated thru the enclosures 236 for efficient transfer of heat.

The lower portion 230 of the heat exchanger 224 has a groove 239 (FIG. 4) formed around the circumferential edge 240 of the open side 234 for receipt of an O-ring 242 shown in FIG. 2. The interior of the heat exchanger 224 also includes structural support members 244. Each of the structural support members 244 have a hole 246 formed therein through which a fastener 248 (FIG. 2) is inserted to attach the first and second portions 230 and 232 of the heat exchanger 224 together and to secure the heat exchanger 224 to the control structure 204 as best shown in FIG. 2. Another groove 250 is formed around each of the holes 246 into which another O-ring 252 is inserted during assembly of the heat exchanger 224. The O-rings 242 and 252 seal the enclosure 236 formed by the first and second portions 230 and 232 when the heat exchanger 224 is assembled to prevent the PCW from leaking out of the heat exchanger 224. A thermal isolation washer 254 is used with the fastener 248 to thermally isolate the fastener 248 so that the design torque applied to the fastener 248 during assembly is maintained under all operating conditions. Accordingly, the heat exchanger 224 incorporates a diagonal or 45° sealing system that reduces the number of fasteners 248 needed to secure the heat exchanger portions 230 and 232 together. This design also permits the same fasteners 248 to attach the heat exchanger assembly 224 to the control structure 204.

The heat exchanger 224 also includes a tooling pin 256 disposed in openings 258 formed in the first and second portions 230 and 232. The tooling pin facilitates manufacturing of the portions 230 and 232 and alignment of the portions 230 and 232 during assembly of the heat exchanger 224.

Figure 5:
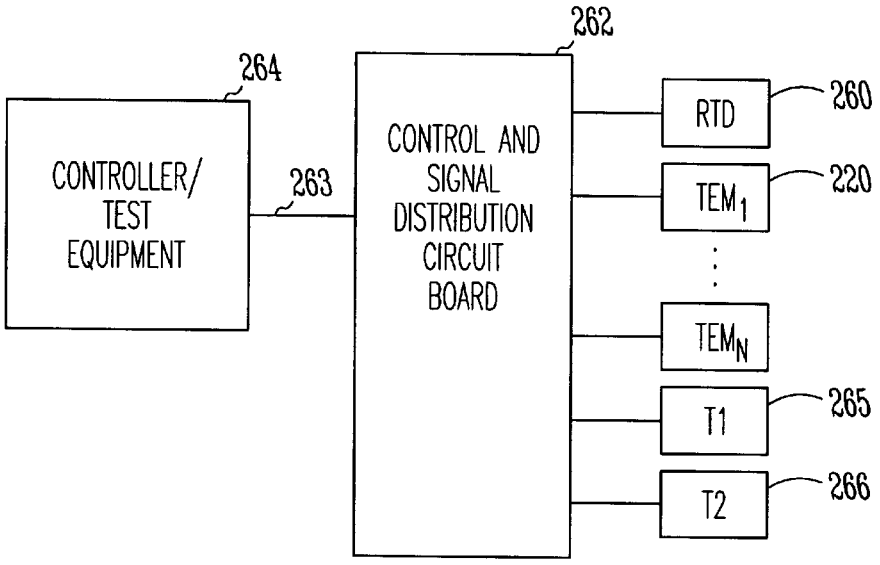
FIG. 5 is a block schematic diagram of the power and control circuitry for the thermal control unit of FIG. 1.

The thermal control unit 200 further includes a resistive temperature device (RTD) 260 thermally coupled to the device 202 under test at a predetermined location. The RTD 260 is also electrically connected to a control and signal distribution circuit board 262 as shown in FIG. 5. The RTD 260 performs as a temperature sensor to sense the temperature of the device 202 and to generate and transmit a signal representative of the temperature of the device 202 to the control and distribution circuit board 262. The control and signal distribution circuit board 262 is also electrically connected to each of the thermoelectric modules ($TEM_N$) 220. As shown in FIG. 5, the control and signal distribution board 262 is connected by a multiple conductor cable 263 to an external controller 264 or test equipment. The test equipment or controller 264 regulates the direction of current flow in the thermoelectric modules 220 to cause the thermoelectric modules 220 to either heat or cool the control structure 204 or portions thereof in response to the temperature signals received by the control and signal distribution circuit 262 and transmitted to the controller 264.

The control and signal distribution circuit board 262 also connects the controller 264 to over temperature sensors 265 and 266 that are positioned in predetermined locations to monitor the temperatures of the heat exchangers 224. If either of the heat exchangers 224 experience a critical temperature, for example the PCW is inadvertently shut off or another malfunction occurs, the power is shut off until the temperature of the heat exchanger 224 is again at a safe operating range.

The control and distribution circuit 262 is positioned above the heat exchangers 224 in a convenient location for routing the power wiring from the thermoelectric modules 220 and control wiring form the RTD 260 and other control wiring. The control and signal distribution circuit 262 also preferably uses a common set of signal and power connectors. This eliminates the need for internal strain relief of the power and signal wiring and improves reliability of the unit 200. This arrangement is also easily scalable to future products that require PPV test flow.

In accordance with one embodiment of the present invention, the RTD 260 may be disposed in a opening 268 formed in the extension member 204*b* and the base member 204*a* of the control structure 204. The RTD 260 may be contained in a holder 270 to protect the RTD 260 and its control wiring during assembly and operation of the thermal control unit 200. The RTD holder 270 may be made of a durable engineering plastic such as Torlon® or the like that maintains its properties under high heat. A biasing arrangement 272 is disposed in the opening 268 to maintain the RTD 260 in thermal contact with the device 202. The biasing arrangement 272 includes a plunger 274 and a spring 276 disposed between the plunger 274 and the RTD 260. A pusher 278 is positioned to push against the spring plunger 274 to bias the spring 276.

The thermal control unit 200 may also include a shroud 280 that covers and seals the thermal control unit 200 and the device 202. The shroud 280 contains a port 282 used to purge atmospheric air from around the device 202 and the thermal control unit 200 to prevent condensation on the device 202 and the thermal control unit 200.

Figure 6:
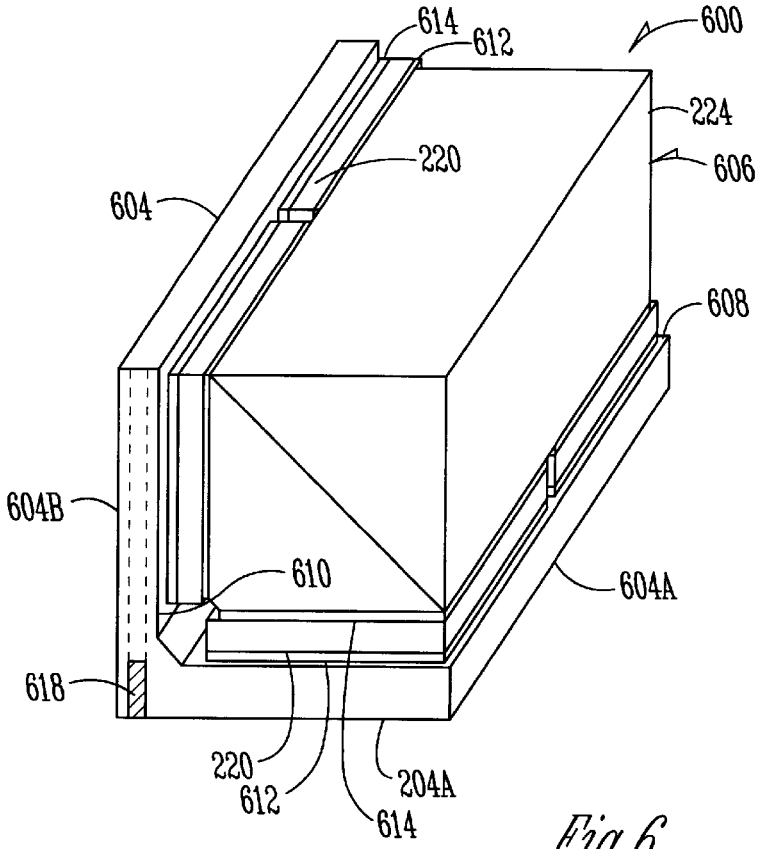
FIG. 6 is a perspective view of a thermal control unit in accordance with another embodiment of the present invention.

FIG. 6 is a perspective view of a thermal control unit 600 in accordance with another embodiment of the present invention. In some circumstances, such as space or design constraints, a three-dimensional control structure 604 may need to be shaped to more appropriately fit the particular design or shape of the device under test (not shown in FIG. 6). For example, the control structure 604 in FIG. 6 is substantially L-shaped with a base member 604*a* and an extension member 604*b* extending from the base member 604*a*. A heat transfer assembly 606 is then placed in thermal contact with the control structure 604. The heat transfer assembly 606 may include at least one thermal electric module 220 thermally coupled to an upper surface 608 of the base member 604*a* and at least one other thermal electric module 220 thermally coupled to one face 610 of the extension member 604*b*. A layer 612 of thermal interface material may be disposed between the base member 604*a* and the thermal electric module 220 and between the one face 610 and the thermal electric module 220 disposed thereon. At least one heat exchanger 224 is thermally coupled to the thermal electric modules 220 on the base member 604*a* and extension member 604*b*. Another layer 614 of thermal interface material may be disposed between the heat exchanger 224 and the thermal electric modules 220. The thermal control unit 600 also includes a temperature sensor 618, such as the resistive temperature device 260 shown in FIG. 2, and a control and signal distribution circuit board (not shown in FIG. 6), such as the board 262, for electrically coupling the temperature sensor 618 and the thermal electric modules 220 to a controller or test equipment 264 (FIG. 5).

Figure 7A:
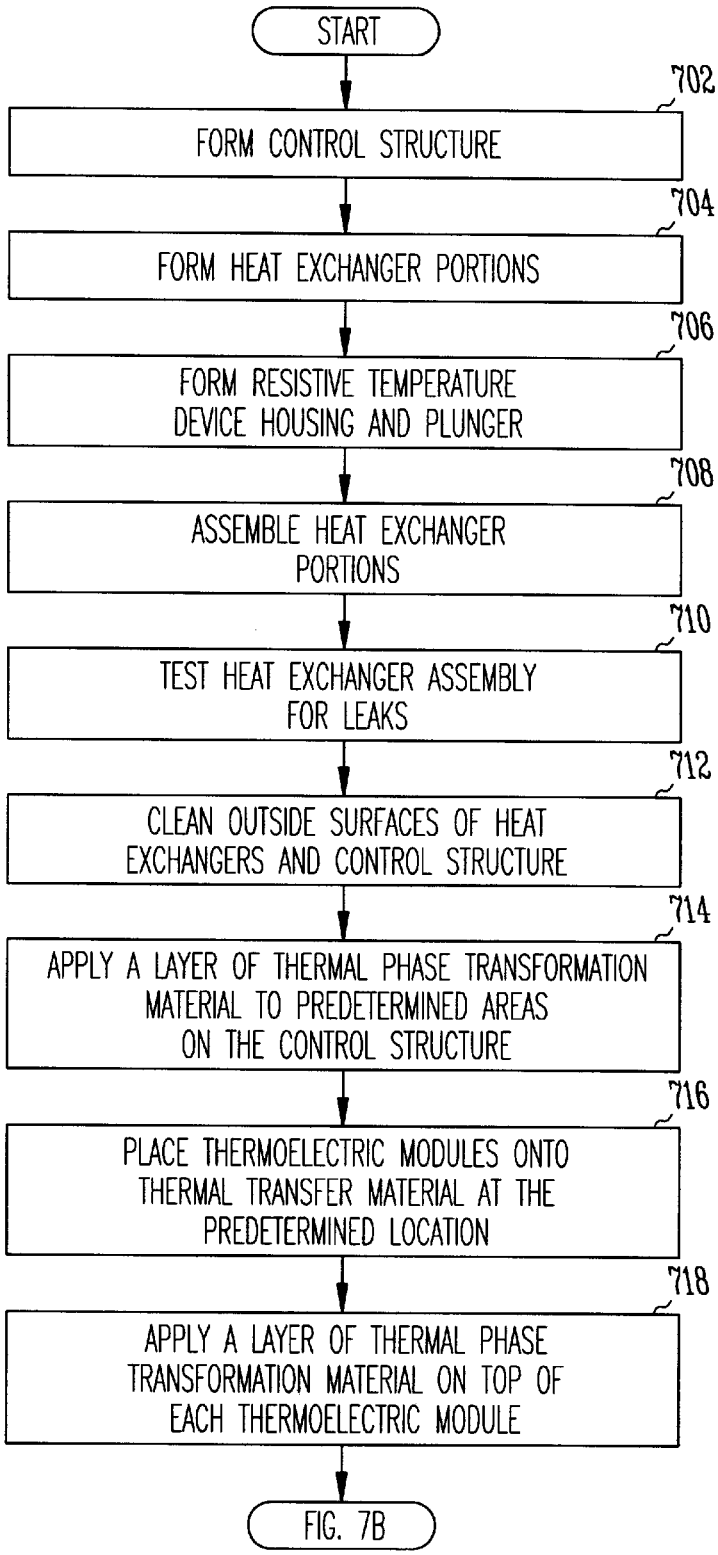
FIGS. 7A and 7B are a flow graph of a method for making a thermal control unit in accordance with the present invention.
Figure 7B:
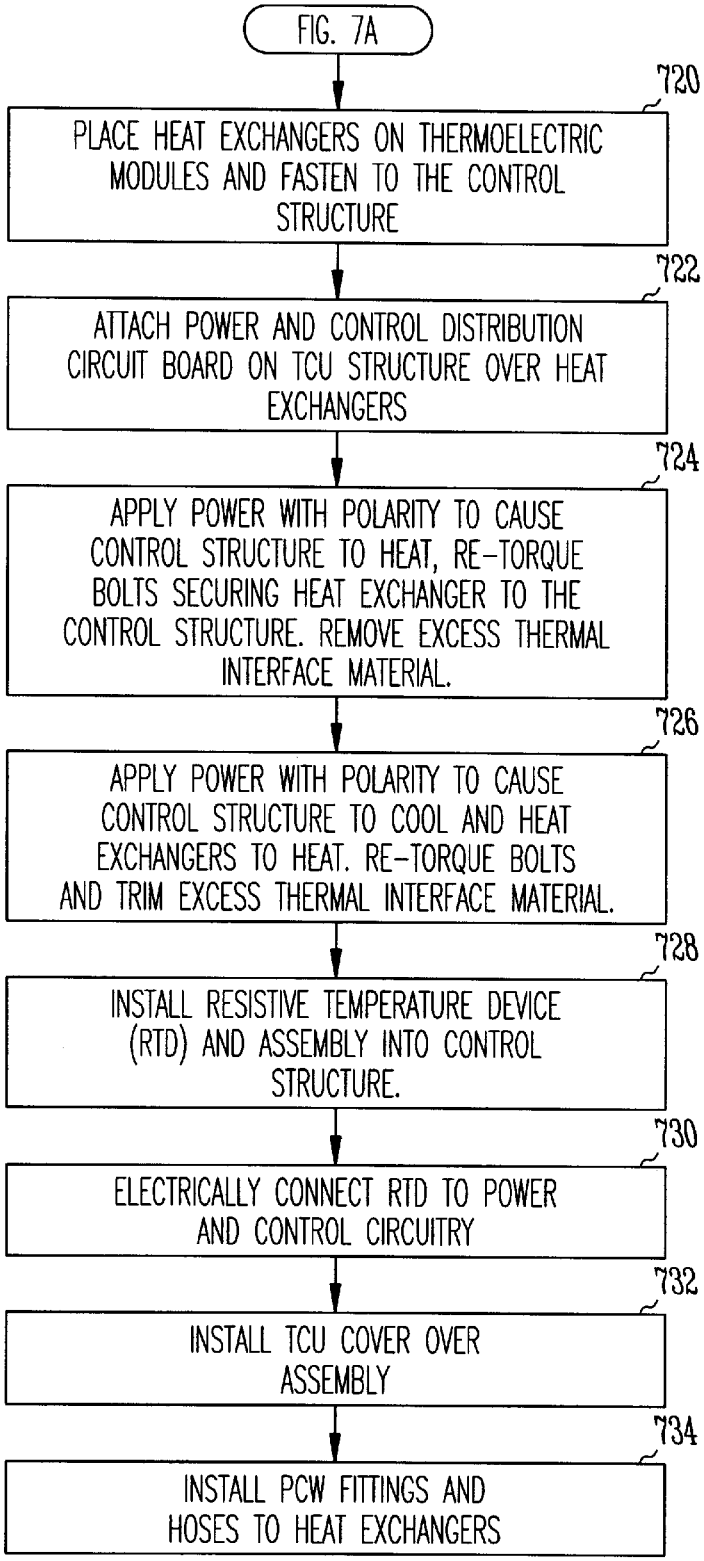

FIGS. 7A and 7B are a flow chart of a method for manufacturing a thermal control unit, such as unit 200 or 600, in accordance with the present invention. In box 702, the control structure 204 or 604 is formed. The control structure 204 is machined from a copper or aluminum billet into a predetermined shape, such as the inverted T-shape of FIGS. 2 and 3, the L-shape of FIG. 6 or some other shape to satisfy design constraints. An opening is drilled through the top of the extension member 204*b* and through the base member 204*a* for the resistive temperature device assembly 260 to be placed. The control structure 204 is then flashed with a coating of nickel to a thickness of about 0.06 mils to prevent copper or aluminum oxidation. In box 704, the heat exchanger portions 230 and 232 are formed by machining 6061-T6 aluminum or the like. After machining to specifications, the heat exchanger portions 230 and 232 are coated with a chemical film to prevent alkaline attack by the chemicals in the PCW. In box 706 the housing or holder 270 and plunger 274 for the RTD 260 is machined from Torlon® to the design specifications.

In box 708, the heat exchanger portions 230 and 232 are assembled with the O-rings 242 and 252 and fasteners 248. The fasteners 248 are torqued to the design requirements. An air hose (not shown in the drawings) is attached to one of the ports 238 of the heat exchanger 224 and the other port is plugged. In box 710, the heat exchanger 224 is submersed completely into water and air pressure at about 100 psig is applied to the heat exchanger enclosure 236. The heat exchanger 224 is then checked for leaks. The pressure may be applied for at least one minute. In box 712, the side surfaces of the heat exchangers 224 and control structure 204 may be cleaned with alcohol and lint-free wipes. In box 714, the layer 218 of thermal interface material or phase transformation material is applied to predetermined areas on the control structure 204. In box 716, the thermoelectric modules 220 are placed onto the control structure 204 in their predetermined locations, thermally coupled to the base member first and second portions 210 and 212 and to the first and second faces 214 and 216 of the extension member 204*b*. In box 718 the other layer 222 of thermal interface material is deposited on each thermoelectric module 220 and in box 720, the heat exchangers 224 are placed on the thermoelectric modules 220 with the first and second sides 226 and 228 respectively thermally coupled to the thermoelectric modules 220 on the base member 204*a* and extension member 204*b*. The heat exchangers 224 are attached to the control structure 204 by fasteners 248 with the thermal isolation washer 254 between the head of each fastener 248 and the heat exchanger 224. The fasteners 248 are then torqued to the design specification.

In box 722, the power and control distribution circuit board 262 is attached to the thermal control unit 200 over the heat exchangers 224. The power wiring for the thermoelectric modules are electrically connected to the circuit board 262, preferably by soldering. In box 724 power is applied to the thermoelectric modules 220 with the proper polarity to cause the control structure 204 to be heated. The heat exchanger fasteners 248 are re-torqued to specifications and any excess thermal interface material is removed. In box 726 the opposite polarity voltage is applied to the thermoelectric modules 220 to cause the control structure 204 to be cooled. Again the fasteners 248 are re-torqued and any excess thermal interface material is removed.

In box 728, the RTD 260 and biasing arrangement 272 are installed. The RTD 260 is inserted into the holder 270 and into the opening 268 formed in the extension member 204*b*. The RTD spring 276 is inserted into the opening 268 followed by the plunger 274. The RTD pusher 278 is then disposed on top of the plunger 274. The RTD control wiring is guided through openings in each of the components during assembly and the wires are electrically connected to the designated terminals on the control and signal distribution circuit board 262 in box 730. A thermal isolation shim 284 may be installed on top of the control structure 204 to thermally insulate the cover or shroud 280 which is installed over the thermal control unit assembly 200 in box 732. The PCW fittings and hoses are then attached to the heat exchangers 224 in box 734.

Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention. Therefore, it is intended that this invention be limited only by the claims and the equivalents thereof.

What is claimed is:

1. A thermal control unit for controlling the temperature of a device, comprising:

a three dimensional control structure for placement in contact with the device;

at least one thermoelectric module thermally coupled to the control structure; and at least one heat exchanger thermally coupled to the at least one thermoelectric module.

2. The thermal control unit of claim 1, further comprising a control and signal distribution circuit electrically connected to the at least one thermoelectric module.

3. The thermal control unit of claim 1, further comprising:

a controller; and a temperature sensor in contact with the device and electrically coupled to the controller to transmit a signal representative of a temperature of the device to the controller, wherein the controller regulates the direction of electrical current flow through the at least one thermoelectric module to either heat or cool the device in response to the signal representative of a temperature of the device.

4. The thermal control unit of claim 1, wherein the control structure comprises:

a base member including one surface and an opposite surface to thermally contact the device; and an extension member including a first face and a second face and extending substantially perpendicular from the one surface of the base member and dividing the one surface into first and second portions.

5. The thermal control unit of claim 4, further comprising a plurality of thermoelectric modules, at least one thermal electric module disposed on each of the first and second portions of the base member and on the first face and the second face of the extension member.

6. The thermal control unit of claim 5, further comprising at least one heat exchanger disposed on each side of the extension member and thermally coupled to the plurality of thermoelectric modules.

7. The thermal control unit of claim 6, wherein each of the at least one heat exchangers comprises a first portion and a second portion, each portion having a substantially triangular cross-section and one of the portion having two sides to thermally contact the thermoelectric modules on the base member and on the extension member and a open third side to matingly attach to an open side of the other portion to form an enclosure for containing a heat transfer fluid.

8. The thermal control unit of claim 7, further comprising at least one fastener extending through the first portion and the second portion of the at least one heat exchanger and into the control structure to secure the first and second portions together and to attach the heat exchanger to the control structure with the two sides of the one portion of the heat exchanger in thermal contact with the thermoelectric modules.

9. The thermal control unit of claim 8, further comprising a o-ring to seal the enclosure of the heat exchanger.

10. The thermal control unit of claim 4, further comprising:

a temperature sensor disposed in an opening formed in the control structure and in contact with the device; and a control and signal distribution circuit electrically connected to the temperature sensor, wherein the temperature sensor generates and transmits to the control and signal distribution circuit a signal representative of a temperature of the device.

11. The thermal control unit of claim 10, further comprising a controller coupled to the control and signal distribution circuit to regulate the direction of current flow through the thermoelectric modules to either heat or cool the control structure in response to the signal representative of the temperature of the device.

12. The thermal control unit of claim 10, wherein the temperature sensor is a resistive temperature device.

13. The thermal control unit of claim 12, further comprising a biasing arrangement to retain the resistive temperature device in thermal contact with the device.

14. The thermal control unit of claim 13, wherein an opening is formed in the extension member and the base member of the control structure and wherein the biasing arrangement comprises:

a resistive temperature device holder disposed in the opening to hold the resistive temperature device at a predetermined location in contact with the device;

a plunger disposed in the opening;

a spring disposed between the plunger and the resistive temperature device holder; and a resistive temperature device pusher to push against the plunger to compress the spring and force the resistive temperature device to be in thermal contact with the device.

15. A thermal control unit for controlling the temperature of a device, comprising:

a three-dimensional control structure including a base member and an extension member extending from one surface of the base member to divide the base member into first and second portions and the base member having another surface to thermally couple to the device;

at least one heat transfer assembly in thermal contact with the first portion of the base member and one face of the extension member; and at least one other heat transfer assembly in thermal contact with the second portion of the base member and another face of the extension member.

16. The thermal control unit of claim 15, wherein each heat transfer assembly comprises:

at least one thermoelectric module thermally coupled to the base member;

at least one other thermoelectric module thermally coupled to the extension member; and a heat exchanger thermally coupled to the thermoelectric modules.

17. The thermal control unit of claim 16, further comprising:

a control and signal distribution circuit electrically connected to each of the thermoelectric modules; and a temperature sensor in contact with the device and electrically connected to the control and signal distribution circuit to generate and transmit signals representative of a temperature of the device to the control and signal distribution circuit.

18. The thermal control unit of claim 16, wherein the heat exchanger comprises a first portion and a second portion, each portion having a substantially triangular cross-section with two sides to thermally couple to the thermoelectric modules on the base member and the extension member and an open side to matingly attach to the open side of the other portion to form an enclosure for containing a heat transfer fluid.

19. The thermal control unit of claim 18, further comprising at least one fastener extending through the first portion and the second portion of the heat exchanger and into the control structure to secure the first and second portions together and to attach the heat exchanger to the control structure with the two sides thermally coupled to the thermoelectric modules.

20. The thermal control unit of claim 15, further comprising:

a controller for controlling the operation of the thermal control unit; and a temperature sensor disposed in an opening formed in the extension member and the base member of the control structure, the temperature sensor being in contact with the device and electrically coupled to the controller to generate and transmit to the controller a signal representative of a temperature of the device.

21. The thermal control unit of claim 20, wherein the temperature sensor is a resistive temperature device.

22. An electronic system for performing a predetermined operation, comprising:

at least one component for performing the predetermined operation;

a thermal control for controlling the temperature of the at least one component, the thermal control unit comprising:

a three-dimensional control structure in thermal contact with the at least one component; and a heat transfer assembly in thermal contact with the control structure.

23. The electronic system of claim 22, wherein the control structure comprises:

a base member including one surface and another surface in thermal contact with the at least one component; and an extension member extending from the one surface of the base member and dividing the base member into first and second portions.

24. The electronic system of claim 23, wherein the heat transfer assembly comprises:

a plurality of thermoelectric modules, at least one thermoelectric module thermally coupled to each of the first portion and the second portion of the base member and at least one thermoelectric module thermally coupled to each of one face and another face of the extension member; and a plurality of heat exchangers, at least one heat exchanger thermally coupled to the thermoelectric modules on the first portion and the one face of the extension member and at least one heat exchanger thermally coupled to the thermoelectric modules on the second portion and the other face of the extension member.

25. The electronic system of claim 24, wherein each heat exchanger comprises a first portion and a second portion, each portion having a substantially triangular cross-section with two sides to thermally couple to the thermoelectric modules on the base member and the extension member and an open side to matingly attach to the open side of the other portion to form an enclosure for containing a heat transfer fluid.

26. The electronic system of claim 23, further comprising:

a controller to control the operation of the thermal control unit; and a temperature sensor disposed in an opening formed in the extension member and the base member of the control structure, the temperature sensor being in contact with the device and electrically coupled to the controller to generate and transmit to the controller a signal representative of a temperature of the device.

27. A method for making a thermal control unit, comprising:

forming a control structure including a base member and an extension member extending from the base member and dividing the base member into first and second portions;

attaching at least one thermoelectric module on each of the first portion of the base member, the second portion of the base member, one face of the extension member and another face of the extension member;

attaching at least one heat exchanger to the control structure and thermally coupling to the first portion of the base member and to the one face of the extension member; and attaching at least one other heat exchanger to the control structure and thermally coupling to the second portion of the base member and to the other face of the extension member.

28. The method of claim 27, further comprising:

forming a first portion of each of the heat exchangers; and forming a second portion of each of the heat exchangers, wherein the first portion and the second portion have a substantially triangular cross-section and the first portion includes a first side and a second side for thermally coupling to the control structure and an open side for matingly attaching to an open side of the second portion to form an enclosure for containing a heat transfer fluid.

29. The method of claim 27, further comprising:

forming an opening in the extension member and the base member; and inserting a temperature sensor into the opening to thermally couple to a device whose temperature is controlled by the thermal control unit.

30. The method of claim 29, further comprising:

electrically connecting the temperature sensor to a control and signal distribution circuit to generate and transmit a signal to the control and signal distribution circuit representative of a temperature of the device whose temperature is to be controlled; and electrically connecting each of the thermoelectric modules to the control and signal distribution circuit.

* * * * *